US009162096B2

(12) United States Patent
Lee

(10) Patent No.: US 9,162,096 B2
(45) Date of Patent: Oct. 20, 2015

(54) AUTOMATIC FIRE EXTINGUISHER CAPABLE OF DISCHARGING FIRE-EXTINGUISHING AGENT TO FIRE SITE

(71) Applicant: Young-bok Lee, Suwon-si (KP)

(72) Inventor: Young-bok Lee, Suwon-si (KP)

( * ) Notice: Subject to any disclaimer, the term of this patent is extended or adjusted under 35 U.S.C. 154(b) by 0 days.

(21) Appl. No.: 14/410,708

(22) PCT Filed: Aug. 9, 2013

(86) PCT No.: PCT/KR2013/007211

§ 371 (c)(1),
(2) Date: Dec. 23, 2014

(87) PCT Pub. No.: WO2014/025233

PCT Pub. Date: Feb. 13, 2014

(65) Prior Publication Data

US 2015/0217155 A1 Aug. 6, 2015

(30) Foreign Application Priority Data

Aug. 10, 2012 (KR) ..... 10-2012-0088017

(51) Int. Cl.

| | |
|---|---|
| ***A62C 13/64*** | (2006.01) |
| ***A62C 35/68*** | (2006.01) |
| ***A62C 37/11*** | (2006.01) |
| ***A62C 37/16*** | (2006.01) |

(52) U.S. Cl.

CPC ..... *A62C 35/68* (2013.01); *A62C 13/64* (2013.01); *A62C 37/11* (2013.01); *A62C 37/16* (2013.01)

(58) Field of Classification Search

CPC .... A62C 13/00; A62C 13/003; A62C 13/006; A62C 13/62; A62C 13/64; A62C 37/11; A62C 37/16

See application file for complete search history.

(56) References Cited

U.S. PATENT DOCUMENTS

| | | | | | |
|---|---|---|---|---|---|
| 3,802,510 | A | * | 4/1974 | Johnson | 169/19 |
| 3,857,446 | A | * | 12/1974 | Kenny | 169/60 |
| 4,633,967 | A | * | 1/1987 | Kranz | 180/274 |
| 5,315,292 | A | * | 5/1994 | Prior | 340/628 |

FOREIGN PATENT DOCUMENTS

| | | | |
|---|---|---|---|
| GB | 455870 | A | * 10/1936 |
| KR | 10-2001-0073937 | A | 8/2001 |
| KR | 10-0716473 | B1 | 5/2007 |
| KR | 10-2010-0054939 | A | 5/2010 |
| KR | 10-2011-040162 | A | 4/2011 |

OTHER PUBLICATIONS

International Searching Authority, International Search Report for PCT/KR2013/007211 dated Aug. 29, 2013.

* cited by examiner

*Primary Examiner* — Ryan Reis

(74) *Attorney, Agent, or Firm* — Sughrue Mion, PLLC

(57) ABSTRACT

The present invention relates to an automatic fire extinguisher capable of automatically discharging a fire-extinguishing agent upon the occurrence of a fire. More particularly, the present invention relates to an automatic fire extinguisher which is capable of automatically discharging a fire-extinguishing agent to a fire site without using power upon the occurrence of a fire to thus efficiently extinguish the fire, and which is also capable of sounding an alarm at an early stage upon the occurrence of a fire, to thus enable people to take swift action. The automatic fire extinguisher of the present invention may ultimately serve as a sprinkler, and can be reused after operation.

9 Claims, 8 Drawing Sheets

AUTOMATIC FIRE EXTINGUISHER CAPABLE OF DISCHARGING FIRE-EXTINGUISHING AGENT TO FIRE SITE

CROSS REFERENCE TO RELATED APPLICATIONS

This application is a National Stage of International Application No. PCT/KR2013/007211 filed Aug. 9, 2013, claiming priority based on Korean Patent Application No. 10-2012-0088017 filed Aug. 10, 2012, the contents of all of which are incorporated herein by reference in their entirety.

TECHNICAL FIELD

The present invention relates to an automatic fire extinguishing discharger which automatically discharges a fire-extinguishing agent upon occurrence of a fire, and more particularly, to an automatic fire extinguishing discharger which automatically discharge a fire-extinguishing agent in the direction of fire upon the occurrence of the fire without using electrical power and thus efficiently suppress the fire and at the same time sound an alarm at an early stage upon the occurrence of the fire, thereby enabling people to take swift action and which can serve as an existing sprinkler even when the fire spreads due to failure of early suppression of the fire and can be reused after operation.

BACKGROUND ART

In general, a fire extinguisher may be classified into a mobile-type fire extinguisher and a fixed-type fire extinguisher. Example of the mobile-type fire extinguisher includes a usual dry powder fire extinguisher equipped in an office or at home and example of the fixed-type fire extinguisher includes a sprinkler, an automatic dispersion-type fire extinguisher etc.

The mobile-type fire extinguisher is a fire extinguisher which can be operated only by a person when the fire breaks out; therefore, such an extinguisher does not work at all in case of fire when a person is not present.

The fixed-type fire extinguisher such as the sprinkler and automatic dispersion-type fire extinguisher sprays fire-extinguishing agent in four unspecified directions at a fixed position or sprays toward a predetermined target or range when the fire extinguisher senses heat in case of fire or when an enclosure of the fire extinguisher is molten or destroyed by the heat as the fire already spreads to be close to the fire extinguisher; therefore, the fire extinguisher has a problem that it cannot spray a sufficient fire-extinguishing agent in the direction of fire to that extent.

Furthermore, conventional fire extinguishers are not provided on themselves with means for automatically sounding an alarm when the fire breaks out and have to be provided with a separate alarm device using electrical power etc., and thus have a problem that they are inefficient and cannot sound the alarm when abrupt power failure and electrical discharge occurred in case of fire.

SUMMARY OF THE INVENTION

Technical Problems

The present invention has been made to solve the above-mentioned problems of the conventional fire extinguisher, and its object is to provide an automatic fire extinguishing discharger which does not use electrical power and thus facilitates management and which can automatically discharge a fire-extinguishing agent in the direction of fire upon the occurrence of the fire and thus efficiently suppress the fire and at the same time sound the alarm in advance upon the occurrence of the fire, thereby enabling people to take swift action.

Another object of the present invention is to provide an automatic fire extinguishing discharger which can serve as an existing sprinkler even when the fire widely spreads due to failure of early suppression of the fire.

Another object of the present invention is to provide an automatic fire extinguishing discharger which can prevent malfunction, thereby preventing a property loss and is easy to reuse.

Yet another object of the present invention is to provide an automatic fire extinguishing discharger which can be combined with existing various fire-extinguishing apparatuses and thus is convenient to use.

Solution to the Problem

As particular means for achieving the above-mentioned objects, the present invention includes a plurality of first bimetals which are disposed at constant angular intervals in a plurality of directions and are deformed when a certain temperature or more is reached due to occurrence of a fire; trigger switches which are rotated by a certain angle from a restrained position to an operational position by deformation of the first bimetals; a trigger disc which is rotated by a certain angle by operations of the trigger switches; a gear trigger which is moved from a restrained position to an operational position by rotation of the trigger disc; a following gear which is restrained or released by the gear trigger; an operation spring which provides the following gear with a driving force; a crank pin which engage a crank stopper of the trigger switch in an operational position; a cam which is rotated by a certain angle by the driving force of the operation spring when the crank pin engages the crank stopper; a valve pin which is pressed by the cam to thereby open a fire-extinguishing agent valve; and a fire-extinguishing agent spray nozzle which is disposed such that it communicates with the fire-extinguishing agent valve and is rotated in the same direction as the crank pin.

Preferably, the first bimetals and the trigger switches may be disposed in a plurality of directions such as 45 degrees or 60 degrees etc.

Preferably, each of the trigger switches includes an operation pin which is pushed rearward by deformation of the first bimetal; an engagement rod which is pushed from a restrained position to an operation position by the operation pin; a rotation plate which is rotated to the operational position due to release of the engagement rod and is provided with the crank stopper; and a torsion spring which provides a driving force for rotating the rotation plate.

Preferably, the rotation plate is provided with an arm and the arm can return the rotation plate to the restrained position.

Preferably, engagement pieces which are pushed by the crank stopper are disposed on the trigger disc at positions corresponding to the trigger switches, and the trigger disc may be rotated by a certain angle when the trigger switch is operated.

Preferably, a protrusion pin is formed on the trigger disc, and the protrusion pin is fixed to the gear trigger and is provided with an elastic force by a spring so that the gear trigger can be positioned in the restrained position.

Preferably, the automatic fire extinguishing discharger further includes a second bimetal which is deformed when a certain temperature or more is reached; an alarm switch which is rotated by a certain angle from a restrained position to an operational position by deformation of the second bimetal; a vibration member which is released by the alarm switch and thus vibrates; an alarm spring which provides a driving force to the vibration member; a hammer which is fixed to the vibration member and vibrates; and a bell-cum-case which is struck by the hammer to thereby sound an alarm.

Preferably, the alarm switch may includes an operation pin which is pushed rearward by the deformation of the second bimetal; an engagement rod which is pushed from a restrained position to a release position by the operation pin; a rotation plate which is rotated to the operational position by release of the engagement rod to thereby release the vibration member; and a torsion spring which provides a driving force for rotating the rotation plate.

Effects of the Invention

The present invention exhibits effects that it can intensively automatically discharge the fire-extinguishing agent in the direction of fire upon the occurrence of the fire and thus efficiently suppress the fire and is operated without using the electrical power and thus is not subject to disability due to the power failure and electrical discharge upon the occurrence of the fire and also is easy to manage and at the same sound the alarm at an early stage upon the occurrence of the fire, thereby enabling people to take swift action.

Furthermore, the present invention exhibits an effect that it can serve as conventional sprinkler by separating a nozzle even when the fire widely spreads due to the failure of early suppression of the fire, if the vertical pipe and connection pipe are made of metal.

In addition, the present invention exhibits an effect that it can be continually reused as long as it is not also lost in the fire after used in a test operation and in case of fire.

BEST MODES FOR CARRYING OUT THE INVENTION

Figure 1:
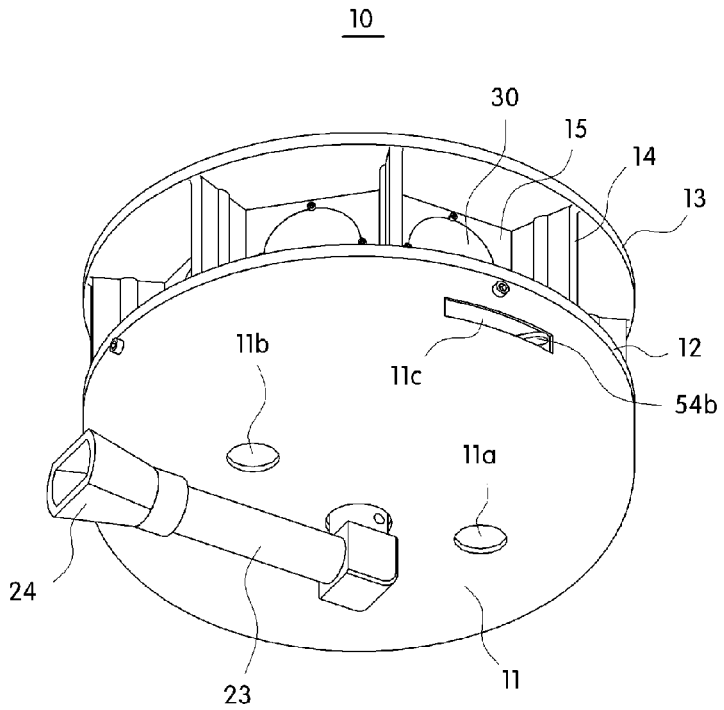
FIG. 1 is a perspective view from above of an automatic fire extinguishing discharger according to the present invention.

The above-described objects, features and advantages of the present invention will be more clear through the following detailed description. Hereinafter, a preferred embodiment of the present invention will be described in detail with reference to the attached drawings.

As illustrated in FIGS. 1 to 12, an automatic fire extinguishing discharger (10) according to a preferred embodiment of the present invention includes a plurality of first bimetals (30) which are disposed at constant angular intervals and are deformed when a certain temperature or more is reached due to occurrence of a fire; trigger switches (40) which are rotated by a certain angle from a restrained position to an operational position by deformation of the first bimetals (30); a trigger disc (70) which is rotated by a certain angle by operations of the trigger switches (40); a gear trigger (90) which is moved from a restrained position to an operational position by rotation of the trigger disc (70); a following gear (104) which is restrained or released by the gear trigger (90); an operation spring (100) which provides the following gear (104) with a driving force; a crank pin (80) which can engage a crank stopper (44*b*) of a rotation plate (44) in an operational position; a cam (81) which is rotated by a certain angle by the driving force of the operation spring (100) when the crank pin (80) engages the crank stopper (44*b*); a valve pin (82) which is pressed by the cam (81) to thereby open a fire-extinguishing agent valve (21); and a fire-extinguishing agent spray nozzle (24) which is disposed such that it communicates with the fire-extinguishing agent valve (21) and is rotated in the same direction as the crank pin (80).

Herein, the first bimetals (30) and the trigger switches (40) may be disposed in a plurality of directions such as 45 degrees or 60 degrees etc. Herein, a specific example is shown where the first bimetals and the trigger switches are disposed on a total of eight faces at angular intervals of 45 degrees.

Each of the trigger switches (40) includes an operation pin (42) which is pushed rearward by deformation of the first bimetal (30); a rotation plate (44) which is provided with the crank stopper (44*b*) that is rotated to the operational position if an engagement protrusion (44*a*) engaged by an engagement rod (41) is released when the engagement rod (41) having inherent elasticity is pushed rearward by the operation pin (42); and a torsion spring (45) which provides a driving force for rotating the rotation plate (44).

The rotation plate (44) is provided with an arm (44*c*) and thus the arm can return the rotation plate (44) to the restrained position.

Furthermore, engagement pieces (71) are disposed on a lower part of the trigger disc (70) at positions corresponding to the trigger switches (40), which engagement pieces are pushed by strike of the crank stopper (44*b*) upon operation of the rotation plate (44). Accordingly, the trigger disc (70) is rotated by a certain angle when the trigger switch (40) is operated.

A protrusion pin (72) is formed on an upper part of the trigger disc (70). The protrusion pin (72) extending through a slot of an upper panel (12) is fixed to the gear trigger (90) and is provided with an elastic force by a spring (91) so that the gear trigger (90) can be positioned in the restrained position.

The automatic fire extinguishing discharger (10) further includes a second bimetal (60) which is deformed when a certain temperature or more is reached; an alarm switch (50) which is rotated by a certain angle from a restrained position to an operational position by deformation of the second bimetal (60); a vibration member (113) which is released by the alarm switch (50) and thus vibrates; an alarm spring (110) which provides a driving force to the vibration member (113); a hammer (114) which is fixed to the vibration member (113) and vibrates; and a bell-cum-case (11) which is struck by the hammer (114) to thereby sound an alarm.

The alarm switch (50) includes an operation pin (52) which is pushed rearward by the deformation of the second bimetal (60); an engagement rod (53) having inherent elasticity which is pushed rearward when the operation pin (52) operates; a rotation plate (54) which is rotated to the operational position by release of the engagement rod (53) to thereby release the vibration member (113); and a torsion spring (55) which provides a driving force for rotating the rotation plate (54).

Figure 5:
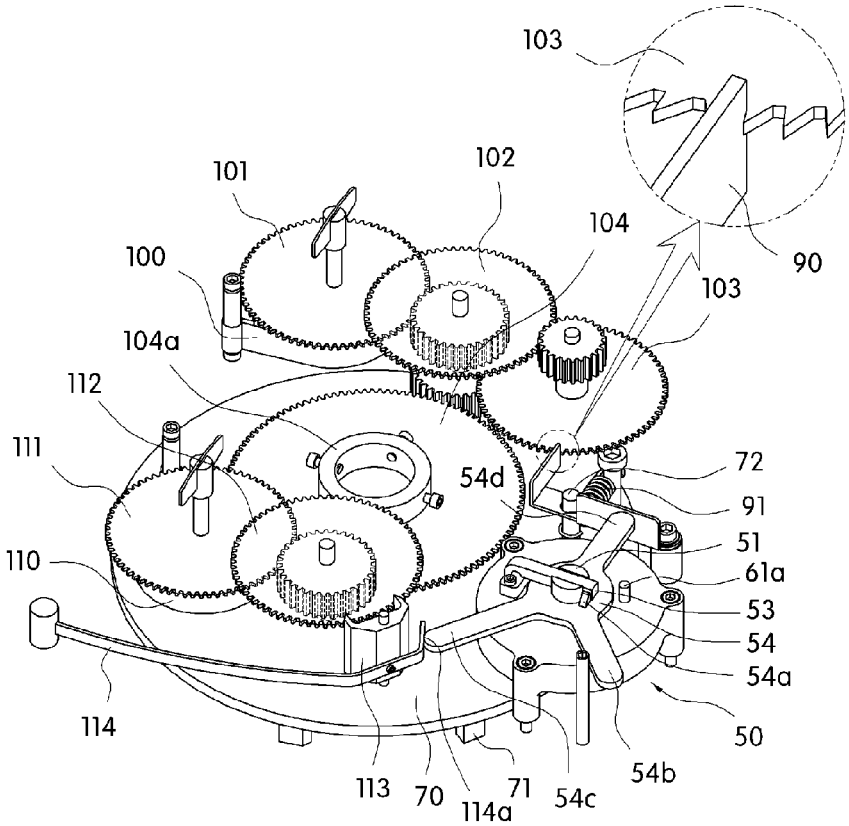
FIGS. 5 and 6 are perspective view showing drive by a spring which is a component of the automatic fire extinguishing discharger according to the present invention.
Figure 6:
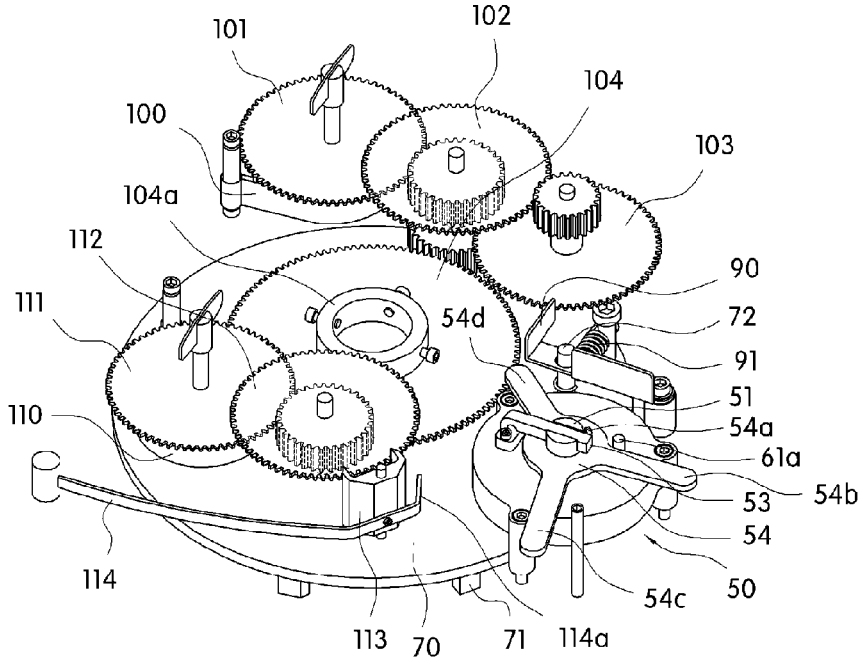

The alarm switch (50) performs a role of generating alarm sound, but also performs a preliminary safety role of preventing a malfunction of the gear trigger (90). Namely, as illustrated in FIG. 5, a malfunction-preventing arm (54*d*) formed on the rotation plate (54) usually stops the gear trigger (90) from being released and thus operating, whereby the malfunction of the gear trigger (90) is prevented. With such a structure, the gear trigger (90) cannot operate until the alarm switch (50) operates first, as illustrated in FIG. 6.

Figure 2:
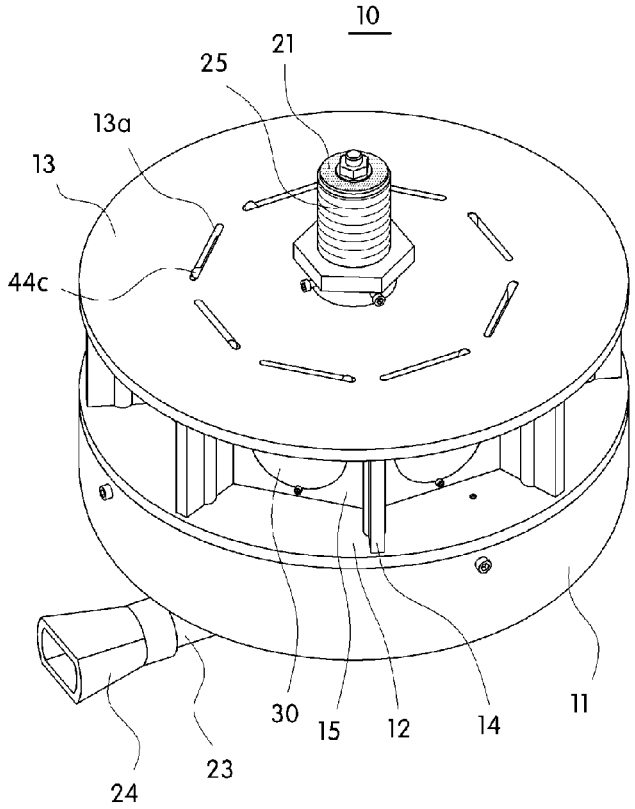
FIG. 2 is a perspective view from below of the automatic fire extinguishing discharger according to the present invention.

Referring to FIGS. 1 and 2, an appearance of the automatic fire extinguishing discharger (10) of the present invention is illustrated. A variable nozzle (24) is connected to a horizontal pipe (23) on an upper part of the automatic fire extinguishing discharger, which nozzle can changed and disposed depending on the type of fire-extinguishing agent and an installation site. The horizontal pipe (23) is connected to a vertical pipe (22) extending through the automatic fire extinguisher and the vertical pipe (22) is rotatably connected to a connection port (25) for a fire-extinguishing apparatus and extends to a valve (21) positioned at an end of the connection port. The connection port (25) is adapted to be screw-coupled with the fire-extinguishing apparatus.

The bell-cum-case (11) made of metal is disposed below the horizontal pipe (23), and the first bimetals (30) are disposed at angular intervals of 45 degrees on the outside of eight faces below the bell-cum-case (11). Therefore, the first bimetals are intended to sense the fire at eight positions. The first bimetals (30) are mounted on the outside of direction face bodies (15) between upper and lower panels (12, 13) and are divided by partitions (14).

Eight elongate slots (13*a*) are formed on a lower surface of the lower panel (13), and arms (44*c*) of the trigger switches (40) are intended to protrude downward through the slots (13*a*). Thus, the trigger switches (40) can be returned to their original positions by using the arms (44*c*) when the automatic fire extinguishing discharger is reused after its operation.

Figure 3:
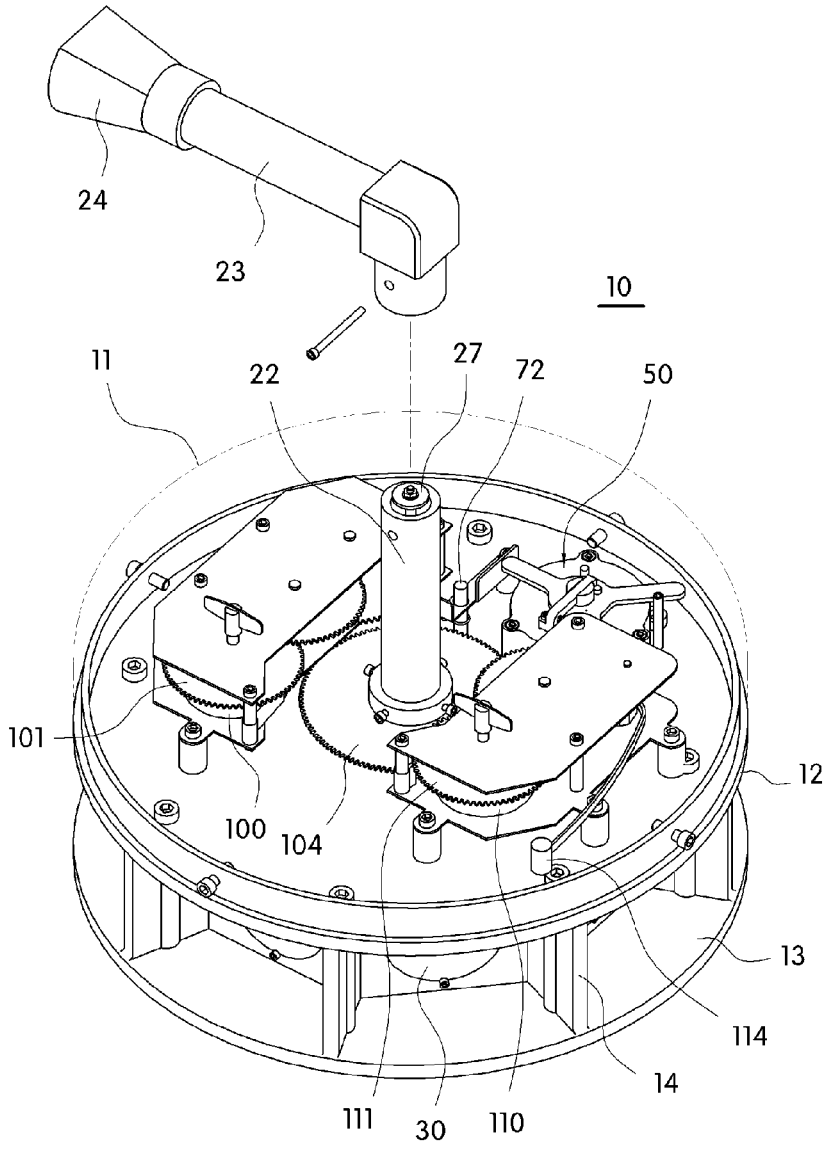
FIG. 3 is a perspective view of the automatic fire extinguishing discharger according to the present invention with a component thereof, i.e. a bell-cum-case being omitted.
Figure 4:
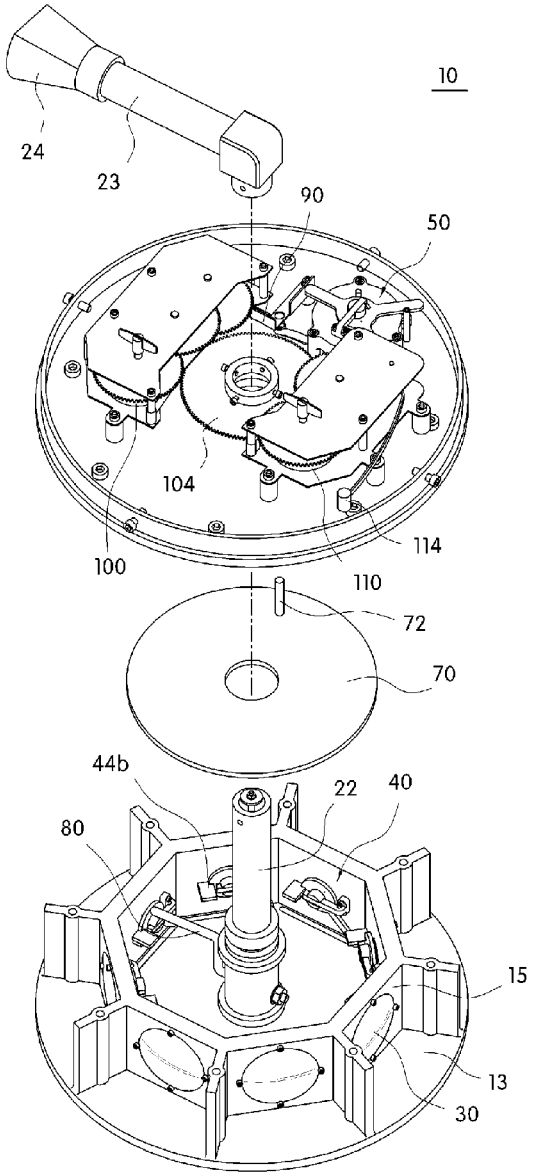
FIG. 4 is an exploded perspective view of the automatic fire extinguishing discharger according to the present invention with it being divided into an upper part, a middle part and a lower part.

Referring to FIGS. 3 and 4, a state is shown where the bell-cum-case (11) is omitted. The operation spring (100) for operating the automatic fire extinguishing discharger (10) and the alarm spring (110) are disposed on both sides between the upper and lower panels (12, 13). The operation spring (100) and the alarm spring (110) drive their respective driving gears (101, 111) first. The operation spring (100) drives a central following gear (104) connected to the vertical pipe (22) by a following gear connection port (104*a*) depending on meshing of the gears (101, 102, 104) with each other, thereby, finally, rotationally driving the vertical pipe (22).

The alarm spring (110) also drives a following gear (112) connected with the driving gear (111) to cause the vibration member (113) to vibrate, whereby the hammer (114) strikes the bell-cum-case (11) to generate the alarm sound.

The trigger disc (70) is disposed below the upper panel (12). The trigger disc (70) is inserted on the vertical pipe (22) in a torque-proof manner. Therefore, irrespective of the rotation of the vertical pipe (22), the trigger disc is intended to be rotated only by the strike of the crank stopper (440*b*) by a certain angle.

When the vertical pipe (22) and the connection pipe (25) are made of metal material, these pipes serves as a sprinkler to the end by distributing the fire-extinguishing agent by means of a dispersing piece (27) disposed on an upper end of the vertical pipe (22) even if another parts are destroyed by the fire.

Referring to FIGS. 5 and 6, the alarm switch (50) is illustrated. FIG. 5 illustrates a state before operation of the alarm switch and FIG. 6 illustrates a state after the operation. A configuration of the alarm switch (50) is illustrated in detail in FIGS. 9 and 10. The alarm switch (50) has a configuration similar to that of the trigger switch (40).

An alarm switch panel (61) is fixed to the upper panel (12) and the second bimetal (60) is fixed to a lower surface of the alarm switch panel. An operation pin (52) is disposed at a center of upper part of the second bimetal (60). The operation pin (52) is intended to push and raise the engagement rod (53) when the bimetal (60) is deformed. A bushing (51) is formed on an upper surface of the alarm switch panel (61), which bushing has a groove which the engagement rod (53) can enter, and a hole through which the operation pin (52) extends is centrally formed through the bushing (51). The rotation plate (54) is rotatably inserted on the bushing (51) and rotational force for the plate is provided by the torsion spring (55). A stop pin (54*a*) is disposed on the rotation plate (54). This stop pin (54*a*) engages the engagement rod (53) before operation, thereby causing the rotation plate (54) to be restrained.

A temperature for the deformation of the second bimetal (60) is set lower than a temperature for the deformation of the first bimetals (30). Therefore, the alarm is sounded first prior to spraying of the fire-extinguishing agent.

When the fire breaks out, the second bimetal (60) is deformed to push and raise the operation pin (52). The operation pin (52) causes the engagement rod (53) to be raised, whereby the stop pin (54*a*) engaging the rod is released and thus the rotation plate (54) is rotated by the driving force of the torsion spring (55). The rotation of the rotation plate (54) causes an alarm arm (54*c*) of the rotation plate (54) to release an end (114*a*) of the hammer (114). The rotation of the rotation plate (54) is stopped when a stop arm (54*b*) engages a stop pin (61*a*) formed on the alarm switch panel (61). At this time, the malfunction-preventing arm (54*d*) of the rotation plate (54) also releases the gear trigger (90) whose rotation is blocked by the arm, whereby the gear trigger (90) is put into a state where it can move.

Referring again to FIGS. 5 and 6, in FIG. 5, the end (114*a*) of the hammer (114) is pressed prior to operation of the alarm switch (50). The hammer (114) is fixed to the vibration member (113). At its one end the vibration member (113) engages the following gear (112) meshing with the driving gear (111) of the alarm spring (110), and then if the vibration member is released from its restraint, it vibrates. Accordingly, the hammer (114) strikes the bell-cum-case (11) while also vibrating, to thereby generate the alarm sound until the driving force of the alarm spring (110) is exhausted.

Meanwhile, the operation spring (100) is fixed to the driving gear (101) and this driving gear (101) transmits the driving force to the central following gear (104) via a pinion (102). The pinion (102) does not only mesh with the following gear (104) but also with a speed-increasing gear (103). The speed-increasing gear (103) is restrained by the gear trigger (90). The protrusion pin (70) is formed on an upper end of the trigger disc (70), and the protrusion pin (72) extending through the slot of the upper panel (12) is fixed to the gear trigger (90) and is provided with elastic force by the spring (91) so that the gear trigger (90) can be positioned in the restrained position.

Therefore, when the trigger disc (70) is rotated by a certain angle, the protrusion pin (72) is naturally rotated over the length of the slot and the gear trigger (90) releases the speed-increasing gear (103) from its restraint. As the restraint is released, the driving force of the operation spring (100) is transmitted to the following gear (104) via the driving gear (101) and the pinion (102) and finally rotates the vertical pipe (22).

Figure 7:
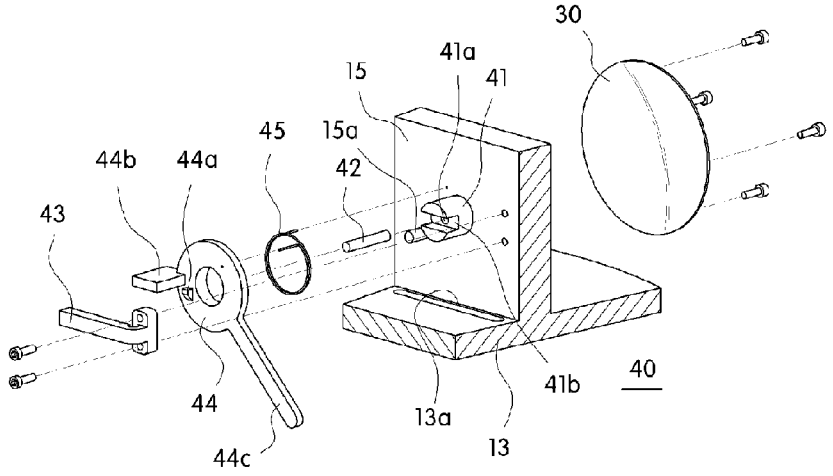
FIG. 7 is an exploded perspective view of a trigger switch which is a component of the automatic fire extinguishing discharger according to the present invention.
Figure 8:
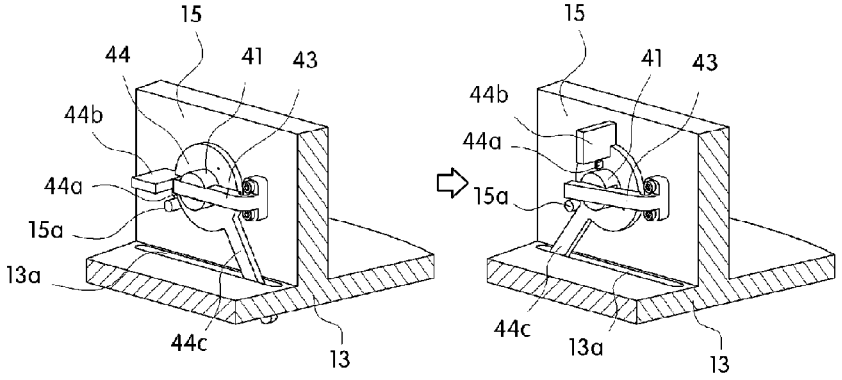
FIG. 8 is a perspective view states before and after operation of the trigger switch which is a component of the automatic fire extinguishing discharger according to the present invention.
Figure 9:
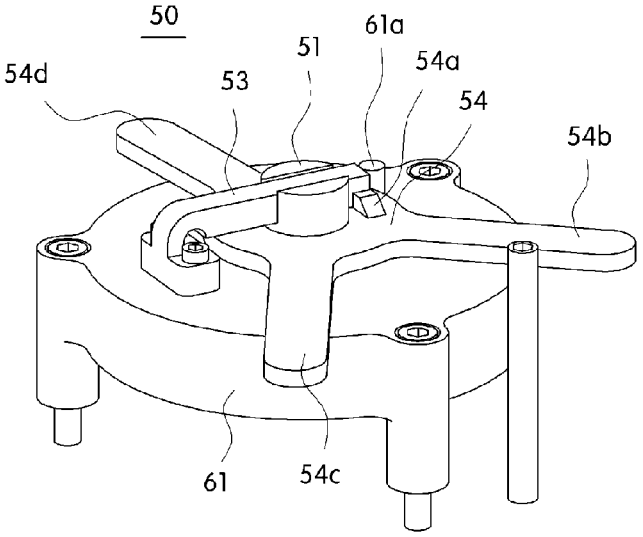
FIG. 9 is a perspective view of an alarm switch which is a component of the automatic fire extinguishing discharger according to the present invention.
Figure 10:
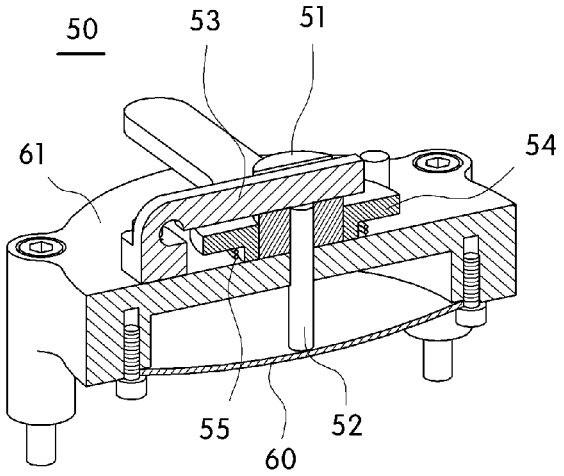
FIG. 10 is a partially-cut perspective view of the alarm switch illustrated in FIG. 9.

Referring to FIGS. 7 and 8, the configuration and operation of one of trigger switches (40) are well illustrated. First, the first bimetal (30) is fixed to an outer surface of the direction face body (15). Formed on the direction face body (15) is a bushing (41) which has a through-hole (41*a*) formed therethrough and a groove (42*b*). The operation pin (42) extending through the through-hole (41*a*) of the bushing (41) is disposed behind the first bimetal (30). The engagement rod (43) is disposed behind the operation pin (42). On an inner side of the engagement rod (43), the rotation plate (44) is inserted and disposed on the bushing (41) and the torsion spring (45) for providing the rotational force to the rotation plate (44) is disposed on an inner side of the rotation plate (44).

The stop pin (44*a*) is formed on the rotation plate (44) and intended to engage the engagement rod (43). The arm (44*c*) is formed at the rotation plate and used for returning the rotation plate (44) to its original position after the operation. Furthermore, The crank stopper (44*b*) is formed on the rotation plate (44) while protruding from the rotation plate (44) vertically thereto and is rotated along with the rotation plate (44).

Referring to FIG. 8, states before and after the operation of the trigger switch (40) are illustrated. As illustrated, the engagement rod (43) engages the stop pin (44*a*) and thus the rotation plate (44) is in the restrained state and the rotation plate (40 is in a pre-rotation state. The crank stopper (44*b*) of the rotation plate (44) stays at a 9 o'clock position and thus is in a position where the crank pin (80) cannot engage the crank stopper even if the pin is rotated.

When the fire breaks out in such a state and thus the first bimetal (30) is deformed, the operation pin (42) pushes the engagement rod (43) rearward, thereby releasing the rod from the stop pin (44*a*), and therefore, the rotation plate (44) is rotated by the elastic force of the torsion spring (45). The rotation plate is rotated until the arm (44*c*) engages the stopper (15*a*) formed on the direction face body (15), and then stops. Then, the crank stopper (44*b*) is positioned at 12-o'clock position, and at this time, if the crank pin (80) is rotated along with the vertical pipe (22), the pin engages the crank stopper (44*b*) at the level of the position.

Figure 11:
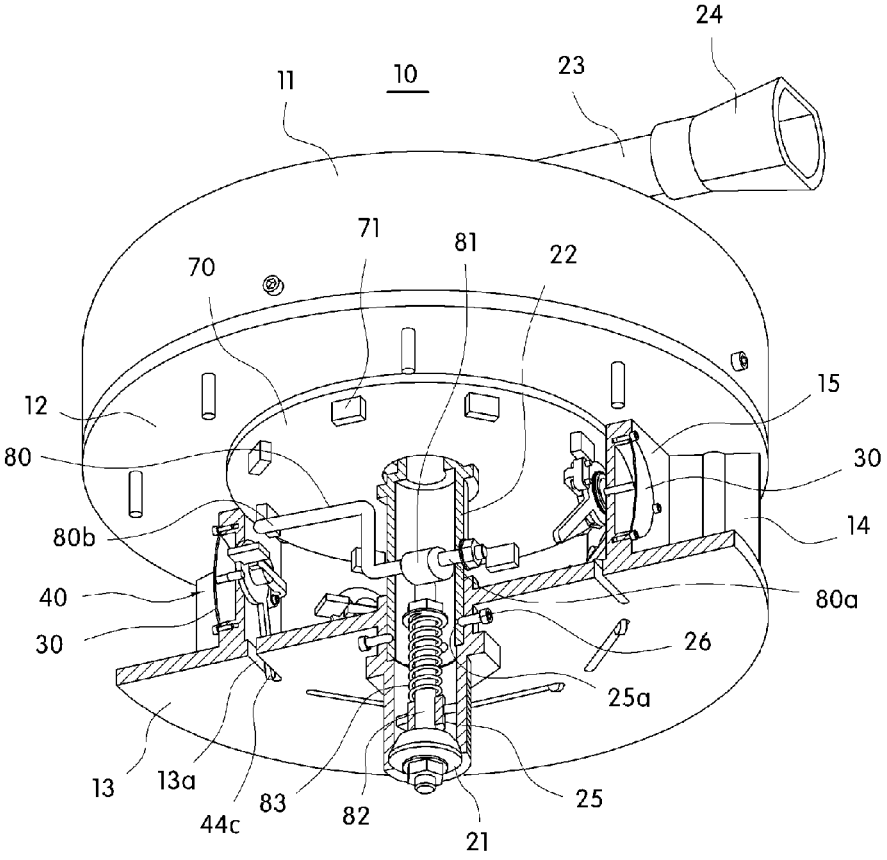
FIG. 11 is a partially-cut perspective view illustrating a state before operation of the automatic fire extinguishing discharger according to the present invention.
Figure 12:
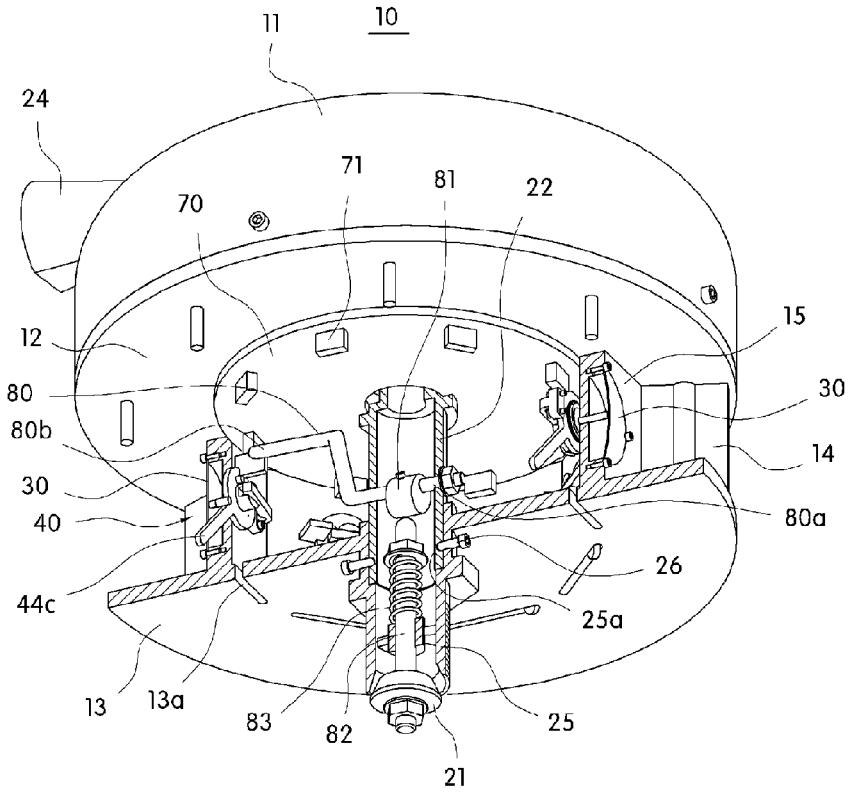
FIG. 12 is a partially-cut perspective view illustrating a state after operation of the automatic fire extinguishing discharger according to the present invention.

Referring to FIGS. 11 and 12, spraying of the fire-extinguishing agent will be described.

As illustrated, the crank stopper (44*b*) of the trigger switch (40) is usually at 9-o'clock position and thus is in a position where the crank pin (80) does not engage the stopper when the vertical pipe (22) rotates. When the fire breaks out in such a state, the alarm is first sounded at a low temperature by convective heat as described above, and the malfunction-preventing arm (54*d*) releases the gear trigger (90).

However, if the fire spreads, the first bimetal (30) arranged for a high operation temperature is deformed by radiant heat in the direction of fire, whereby the trigger switch (40) is operated and thus the rotation plate (44) is rotated, and the crank stopper (44*b*) is brought to the highest 12-o'clock position as shown FIG. 12. At the same time, the crank stopper (44*b*) strikes the engagement piece (71) of the trigger disc (70), thereby rotating the trigger disc (70) by a certain angle. Then, the gear trigger (90) releases the speed-increasing gear (103). Then, the operation spring (100) transmits its driving force to the following gear (104), whereby the vertical pipe (22) is finally rotated. The crank pin (80) rotated along the vertical pipe (22) arrives at a position of the operated trigger switch (40) and thus an end of the crank pin engages the crank stopper (44*b*). Of course, the level of the crank pin (80) is lower than that of the engagement piece (71) of the trigger disc (70), so that the crank pin does not engages the engagement piece.

If the end (80*b*) of the crank pin (80) engages the crank stopper (44*b*), the vertical pipe (22) cannot be rotated although the transmission of the driving force of the operation spring (100) enables the vertical pipe to be continuously rotated. The driving force rotates the crank pin (80) and thus the cam (81) fitted on a cam shaft (80*a*) of the crank pin (80) within the vertical pipe (22) is rotated to press the valve pin (82), and as the valve pin (82) is pressed, the valve (21) is lowered and opened while overcoming the elastic force of the spring (83).

When the valve (21) is opened, the fire-extinguishing agent or fire-extinguishing water flows in through the connection pipe (25) connected to the vertical pipe (22) and is sprayed from the nozzle (24) through the horizontal pipe (23) with the pressure. At this time, the fire-extinguishing agent is sprayed exactly in the direction of the fire and thus early suppression of the fire is possible since the nozzle (24) is disposed so as to always point in the same direction as the crank pin (80).

The vertical pipe (22) is connected with the connection pipe (25) by a bolt (26) having a globular end. The bolt (26) penetrates the connection pipe (25) and engages a ring-shaped groove (25*a*) formed on an outer surface of the vertical pipe (22). Therefore, the vertical pipe (22) can rotate and does not depart from the connection tube (25) even when the fire-extinguishing agent is sprayed.

If the automatic fire extinguishing discharger is made of corrosion-resistant material, it can be repeatedly reused as long as it is not also lost in the fire after the test operation and operation for the suppression of the fire. At the time of reuse, the rotation plate arm (54*b*) protruding outward through an arm slot (11*c*) pierced on a side surface of the bell-cum-case (11) is first pushed in an opposite direction to the operation direction until the stop pin (54*a*) engages the engagement rod (53), to thereby be positioned in its original position, and thereafter the alarm spring (110) is wound through an alarm spring winder slot (11*b*).

Furthermore, by rotating the horizontal pipe (22) by an angle corresponding to the operation in the opposite direction to the operation direction and moving an operated arm (43*c*) of the arms (43*c*) protruding outward from the slot (13*a*) of the lower panel (13) to its original position until the stop pin (44*a*) engages the engagement rod (43), the gear trigger (90)

automatically returns to its original position by means of the elasticity of the spring (91). Thereafter, if the operation spring (100) is wound through an operation spring winder slot (11*a*), reuse is rendered possible.

Figure 13:
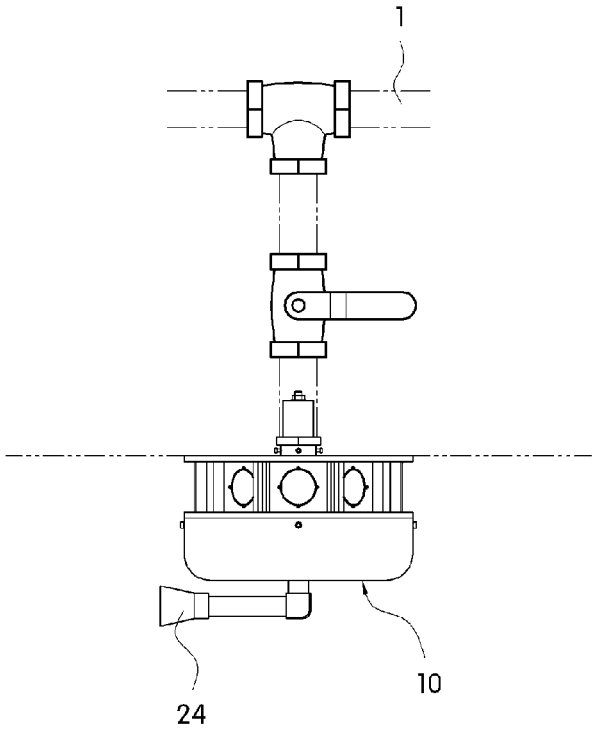
FIG. 13 is a front view showing that the automatic fire extinguishing discharger according to the present invention is connected to a water conduit.

Meanwhile, it is illustrated in FIG. 13 that the automatic fire extinguishing discharger (10) according to the present invention is installed by being connected to a water conduit (1) in which pressurized fire-extinguishing water flows.

Figure 14:
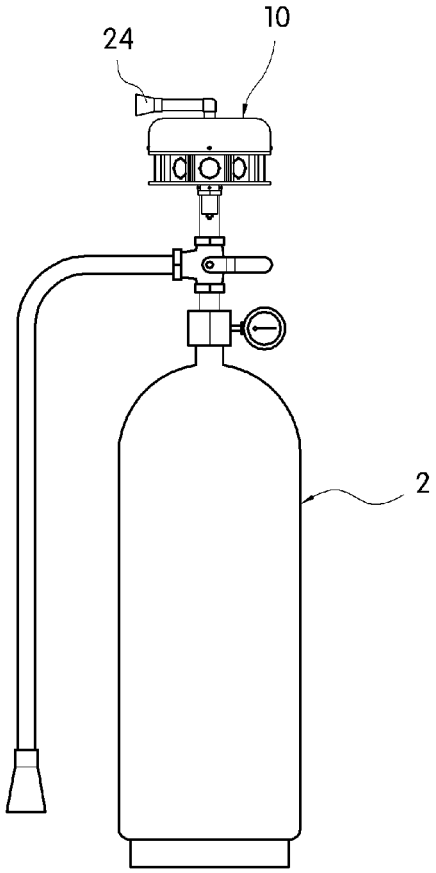
FIG. 14 is a front view showing that the automatic fire extinguisher according to the present invention is connected to a fire extinguisher.

Furthermore, it is illustrated in FIG. 14 that the automatic fire extinguishing discharger (10) according to the present invention is installed by being connected with a fire-extinguishing tank (2) containing the fire-extinguishing agent. It is designed so that the fire-extinguishing agent is intended to be spurted instead of the fire-extinguishing water. Such an automatic fire extinguishing discharger (10) has a good portability and mobility and thus may be frequently changed in position by a firefighting designer. Namely, in a case where fire-using apparatuses are arranged again in a certain space, the position of the extinguishing tank (2) is also changed accordingly, whereby preparation for fire can be actively made.

The present invention described above is not limited to the above-described embodiment and attached drawings, and it is apparent to those skilled in the art that various substitutions, modifications and alterations may be made without departing from the technical concept of the present invention.

What is claimed is:

1. An automatic fire extinguishing discharger comprising:

a plurality of first bimetals which are disposed at constant angular intervals in a plurality of directions and are deformed when a certain temperature or more is reached due to occurrence of a fire;

trigger switches which are rotated by a certain angle from a restrained position to an operational position by deformation of the first bimetals;

a trigger disc which is rotated by a certain angle by operations of the trigger switches;

a gear trigger which is moved from a restrained position to an operational position by rotation of the trigger disc;

a following gear which is restrained or released by the gear trigger;

an operation spring which provides the following gear with a driving force;

a crank pin which engage a crank stopper of the trigger switch in an operational position;

a cam which is rotated by a certain angle by the driving force of the operation spring when the crank pin engages the crank stopper;

a valve pin which is pressed by the cam to thereby open a fire-extinguishing agent valve; and a fire-extinguishing agent spray nozzle which is disposed such that it communicates with the fire-extinguishing agent valve and is rotated in the same direction as the crank pin.

2. The automatic fire extinguishing discharger according to claim 1, wherein the first bimetals and the trigger switches are disposed at angular intervals of 45 degrees or 60 degrees.

3. The automatic fire extinguishing discharger according to claim 1, wherein each of the trigger switches comprises an operation pin which is pushed rearward by deformation of the first bimetal; an engagement rod which is pushed from a restrained position to an operation position by the operation pin; a rotation plate which is rotated to the operational position due to release of the engagement rod and is provided with the crank stopper; and a torsion spring which provides a driving force for rotating the rotation plate.

4. The automatic fire extinguishing discharger according to claim 3, wherein the rotation plate is provided with an arm and the arm returns the rotation plate to the restrained position.

5. The automatic fire extinguishing discharger according to claim 1, wherein engagement pieces which are pushed by the crank stopper are disposed on the trigger disc at positions corresponding to the trigger switches, and the trigger disc is rotated by a certain angle when the trigger switch is operated.

6. The automatic fire extinguishing discharger according to claim 1, wherein a protrusion pin is formed on the trigger disc, and the protrusion pin is fixed to the gear trigger and is provided with an elastic force by a spring so that the gear trigger can be positioned in the restrained position.

7. The automatic fire extinguishing discharger according to claim 1, wherein the automatic fire extinguishing discharger further comprises a second bimetal which is deformed when a certain temperature or more is reached; an alarm switch which is rotated by a certain angle from a restrained position to an operational position by deformation of the second bimetal; a vibration member which is released by the alarm switch and thus vibrates; an alarm spring which provides a driving force to the vibration member; a hammer which is fixed to the vibration member and vibrates; and a bell-cum-case which is struck by the hammer to thereby sound an alarm.

8. The automatic fire extinguishing discharger according to claim 7, wherein the alarm switch comprises an operation pin which is pushed rearward by the deformation of the second bimetal; an engagement rod which is pushed from a restrained position to a release position by the operation pin; a rotation plate which is rotated to the operational position by release of the engagement rod to thereby release the vibration member; and a torsion spring which provides a driving force for rotating the rotation plate.

9. The automatic fire extinguishing discharger according to claim 8, wherein a malfunction-preventing arm is provided on the rotation plate and releases or restrain the gear trigger.

* * * * *